US005799422A

United States Patent [19]

Demuth et al.

[11] Patent Number: 5,799,422

[45] Date of Patent: Sep. 1, 1998

[54] STEAM IRON SOLE-PLATE WITH DEPRESSIONS AND RECESS

[75] Inventors: Ulrich Demuth, Erbach; Norbert Voss, Offenbach; Harald Walther, Würzberg., all of Germany

[73] Assignee: Rowenta-Werke GmbH, Offenbach, Germany

[21] Appl. No.: 920,271

[22] Filed: Aug. 22, 1997

[30] Foreign Application Priority Data

Aug. 29, 1996 [DE] Germany ..... 196 34 870.6

[51] Int. Cl.[6] ..... D06F 75/38

[52] U.S. Cl. ..... 38/93

[58] Field of Search ..... 38/74, 76, 77.9, 38/80, 81, 93; 219/245, 254, 255

[56] References Cited

U.S. PATENT DOCUMENTS

| | | | |
|---|---|---|---|
| 222,849 | 12/1879 | Welch et al. . | |
| 277,193 | 5/1883 | Ball | 38/93 |
| 2,729,004 | 1/1956 | Swanson | 38/93 |
| 2,750,691 | 6/1956 | Parr . | |
| 2,864,185 | 12/1958 | Vance | 38/93 |
| 4,685,229 | 8/1987 | Moravek et al. | 38/93 X |
| 5,592,763 | 1/1997 | Hahnewald et al. | 38/93 X |
| 5,613,309 | 3/1997 | Amsel et al. | 38/93 X |

FOREIGN PATENT DOCUMENTS

| | | |
|---|---|---|
| 70 33 464 | 12/1970 | Germany . |
| 41 03 794 | 5/1992 | Germany . |
| 41 07 236 | 9/1992 | Germany . |

*Primary Examiner*—Ismael Izaguirre
*Attorney, Agent, or Firm*—Cohen, Pontani, Lieberman & Pavane

[57] ABSTRACT

A steam iron with an electrically heated sole-plate, which has numerous steam holes that open in ball-like depressions. The sole-plate has a recess, which is open on the ironing-surface side and is surrounded by the ironing surface. Further steam holes open on the bottom of the recess.

4 Claims, 3 Drawing Sheets

II
1
2
3
7
9
8
5
4
II

STEAM IRON SOLE-PLATE WITH DEPRESSIONS AND RECESS

BACKGROUND OF THE INVENTION

1. Field of the Invention

The invention relates to a steam iron.

2. Description of the Prior Art

In steam ironing, the iron is guided in all directions over the material to be ironed, whereby the heated sole-plate of the iron slides across the material. Steam produced in a vaporization chamber is conveyed into the material through steam holes provided in the sole-plate. The sliding friction between the material and the sole-plate makes it harder for the user to move the iron across the material.

German reference DE PS 41 03 794 teaches a steam iron that has ball-like recesses around the steam holes in the ironing surface of the sole-plate. The recesses are provided for the purpose of creating a steam cushion between the sole-plate and the material being ironed. However, recesses of this type do not suffice to reduce the sliding friction between the sole-plate and the material to such an extent that handling the iron while steam ironing becomes significantly easier.

SUMMARY OF THE INVENTION

Accordingly, it is an object of the present invention to provide a steam iron with an ironing surface which reduces the sliding friction between the sole-plate and the material being ironed to such an extent that handling the iron while steam ironing becomes significantly easier.

Pursuant to this object, and others which will become apparent hereafter, one aspect of the present invention resides in a steam iron having an electrically heated sole-plate which has an ironing surface with ball-like depressions and a plurality of steam holes arranged in the ball-like depressions. An open recess is formed in the ironing surface of the sole-plate so that the recess is surrounded by the ironing surface. A further plurality of steam holes is arranged in the bottom of the recess.

The sole-plate described here is based on the discovery that a mere 60% of the usual sole-plate surface suffices for the actual purpose of ironing, i.e., drying and smoothing material fibers that have been swollen and made malleable by steam. The steam hereby performs not only the task of causing natural fibers to swell, but also, in particular, that of conveying heat into the textiles, including those with artificial fibers.

In addition to reducing the sliding friction, it is a further object of the present invention to improve the conveyance of steam into the textiles and improve the smoothing of the fibers.

When the steam iron according to the invention is placed upon material for the purpose of ironing with steam, a flat empty space is created under its sole-plate by means of a recess of defined depth that is centrally located in a defined geometry. Steam from the vaporization chamber is fed into this empty space through steam holes, so that pressure builds up in the recess. As a result, a steam cushion forms under the sole-plate. Thanks to this cushion and also to the considerably smaller effective sliding surface that results from there being an empty space in the sole-plate, the sliding friction is reduced significantly. Moreover, the conveyance of steam into the material being ironed is significantly improved by means of the large and partially pressurized steam surface.

To ensure that the fibers inside the empty space remain truly separate, the depressed surface has a pattern of spherical segments that simultaneously masses and expands the fibers and thus allows the steam to penetrate more easily. The sole-plate according to the invention offers sliding behavior that is clearly distinguished from that provided by prior sole-plate constructions.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
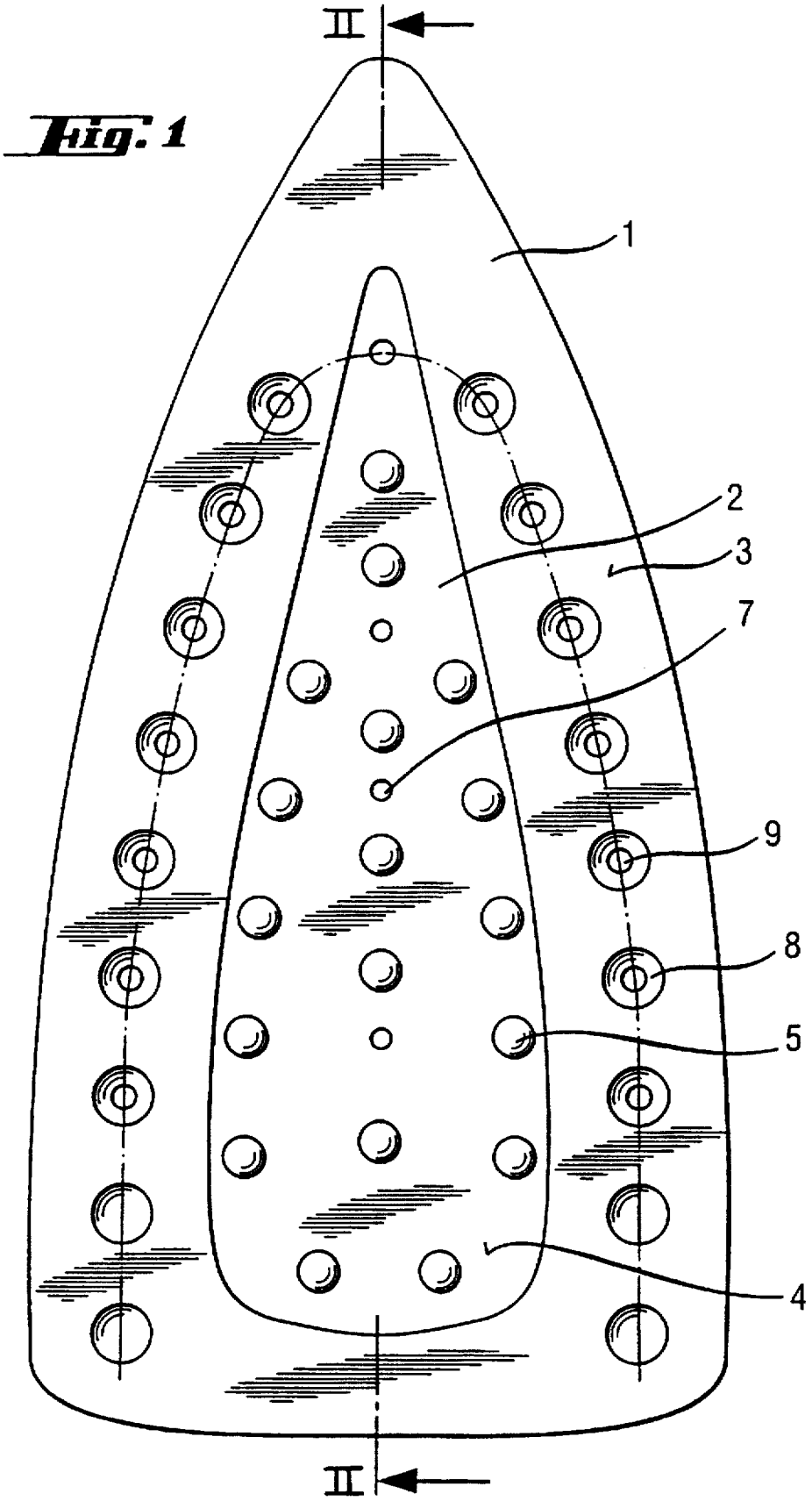
FIG. 1 shows the ironing surface of the sole-plate according to the invention, viewed from above.
Figure 2:
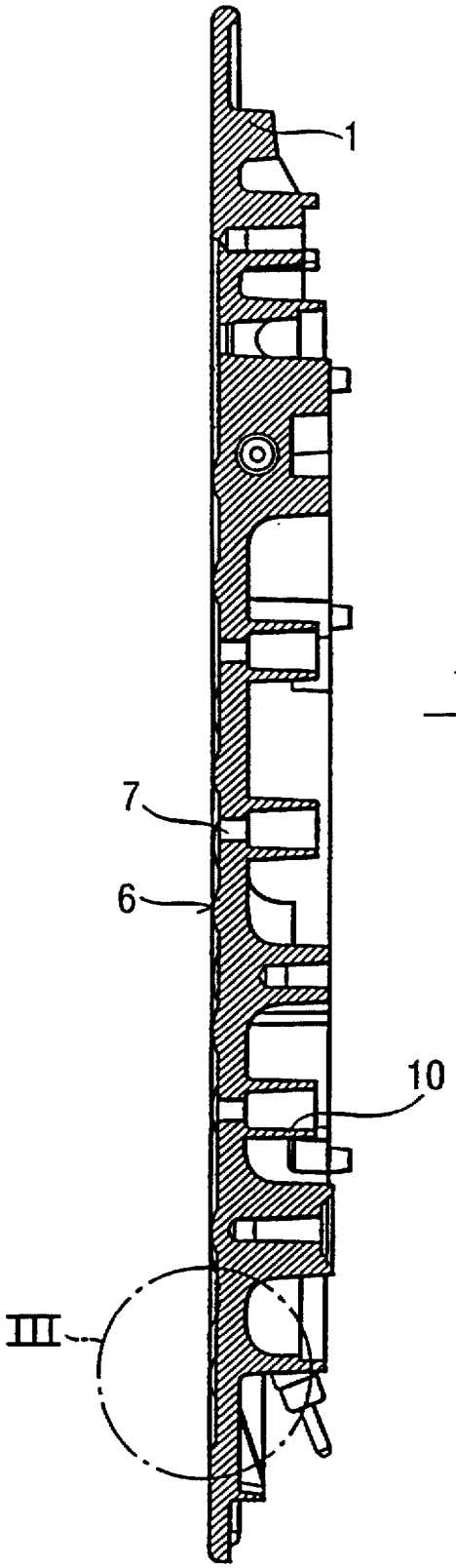
FIG. 2 is a longitudinal section through the sole-plate along Line 11—11 as in FIG. 1.
Figure 3:
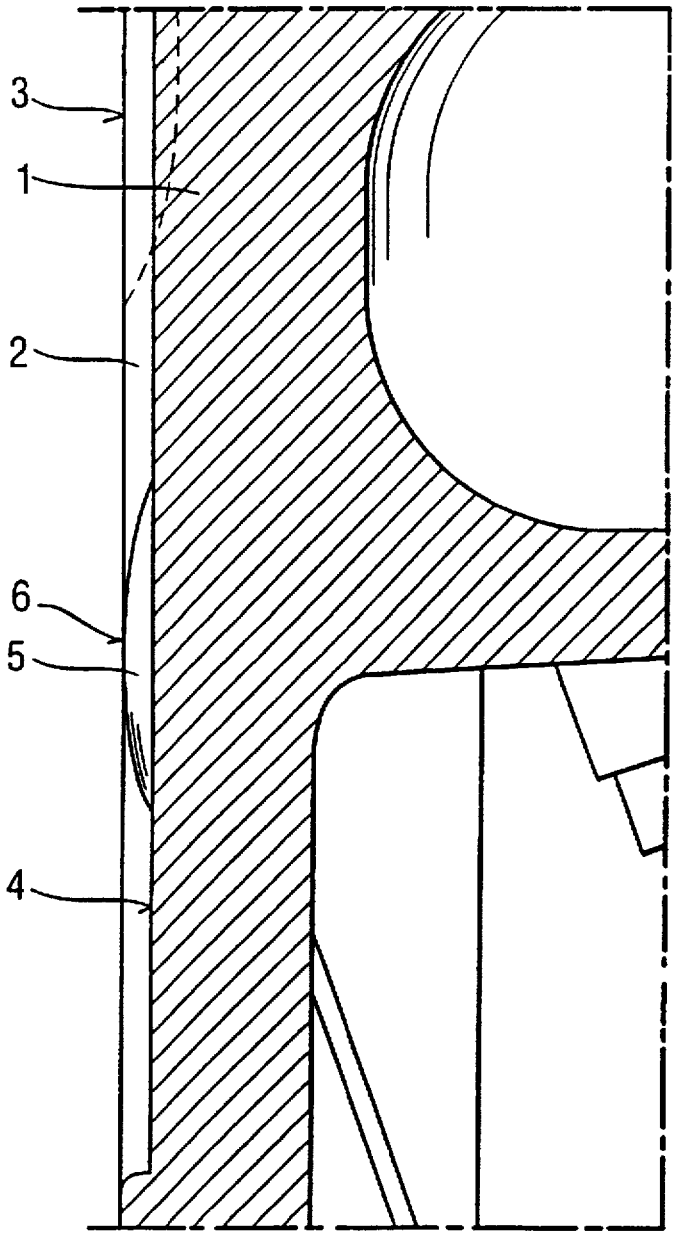
FIG. 3 is an enlarged detail III of the sole-plate in FIG. 2.

As FIGS. 1, 2 and 3 show, a sole-plate 1 of an iron has a flat recess 2 on the ironing-surface side. The recess 2 is deeper than the ironing surface 3, and the outer contour of the recess 2 substantially follows the outer contour of the sole-plate 1. The recess 2 is thus surrounded by the ironing surface 3. Steam holes 7, which are effectively connected via a dome 10 to a vaporization chamber (not shown), open on a bottom 4 of the recess 2. The bottom 4 has elevations 5, preferably in the shape of spherical segments. The free ends 6 of the elevations 5 are flush with the ironing surface 3.

The ironing surface 3 has preferably ball-like depressions 8 in which further steam holes 9 open.

The invention is not limited by the embodiments described above which are presented as examples only but can be modified in various ways within the scope of protectiondefined by the appended patent claims.

I claim:

1. A steam iron, comprising an electrically heated sole-plate, which has an ironing surface with ball-like depressions and a plurality of steam holes arranged in the ball-like depressions, an open recess being formed in the ironing surface of the sole-plate so that the recess is surrounded by the ironing surface, the recess having a bottom, a further plurality of steam holes being arranged in the bottom of the recess.

2. A steam iron as defined in claim 1, wherein the bottom of the recess is configured to have elevations shaped as spherical segments with free ends that are flush with the ironing surface.

3. A steam iron as defined in claim 1, wherein the sole-plate has an outer peripheral contour, the recess being configured to have an outer contour that substantially corresponds to the outer contour of the sole-plate.

4. A steam iron as defined in claim 1, wherein the sole-plate defined an area, the ironing surface and the recess being configured so that the ironing surface has an area equal to 60% of the sole-plate area.

* * * * *